US005214594A

United States Patent [19]

Tyler et al.

[11] Patent Number: 5,214,594

[45] Date of Patent: May 25, 1993

[54] WASTE DISPOSAL SYSTEM

[75] Inventors: Donald Tyler; Bobby W. Hughes, both of Columbus, Ga.

[73] Assignee: Heuristic Technology Inc., Columbus, Ga.

[21] Appl. No.: 852,754

[22] Filed: Mar. 17, 1992

Related U.S. Application Data

[63] Continuation of Ser. No. 429,037, Oct. 30, 1989, abandoned.

[51] Int. Cl.[5] ..... B30B 15/00

[52] U.S. Cl. ..... 364/550; 100/229 A; 100/252; 364/508; 364/551.01

[58] Field of Search ..... 100/229 A, 252; 364/508, 550, 551.01

[56] References Cited

U.S. PATENT DOCUMENTS 3,659,427 5/1972 Harza ..... 100/229 A X
3,765,147 10/1973 Ippolito et al. ..... 100/229 A X
3,822,638 7/1974 Merkin ..... 100/215 X
3,921,152 11/1975 Hagar et al. ..... 364/550 X
4,773,027 9/1988 Neumann ..... 100/229 A X
5,016,197 5/1991 Neumann et al. ..... 100/229 A X

*Primary Examiner*—Edward R. Cosimano
*Attorney, Agent, or Firm*—Jones & Askew

[57] ABSTRACT

A waste disposal system is disclosed wherein the fullness of a plurality of trash collection units equipped with industrial compactors can be monitored at or by a central processing unit. The invention recognizes that the compaction cycle of an industrial compactor exerts a force against the trash being compacted, which force translates into a strain on components of the compaction assembly. The stress exerted against the compaction assembly when it is compacting trash is determined by an electronic sensing device. This strain measurement correlates to the amount of trash in the receptacle and, accordingly, is utilized to determine whether the receptacle is in fact full and in need of being emptied. The stress measurement is obtained by electronically measuring the strain exerted against a component of the compaction assembly as a result of the trash compacting action.

9 Claims, 5 Drawing Sheets

WASTE DISPOSAL SYSTEM

This is a continuation of application Ser. No. 429,037, filed Oct. 30, 1989, now abandoned.

FIELD OF INVENTION

The present invention relates to industrial trash compactors. More particularly, the present invention relates to a device that monitors the fullness of a plurality of trash compactors and allows individual trash compactors to be emptied only when full.

BACKGROUND OF THE INVENTION

Due in large part to environmental concerns, the management of trash and refuse disposal has become very important. As a given population increases, the amount of trash generated also increases. This situation is complicated by the fact that the public demand for disposable goods is seemingly insatiable. More and more products ranging from food items to industrial machinery are provided in containers made of "disposable" polystyrenes and like compounds. Even if a given population were to remain constant in number, the amount of trash generated by that population continues to increase. Thus, it has become necessary to develop techniques and equipment that can process and dispose of greater and greater amounts of trash.

A primary stage in trash management is collection. It is well known to use a large or industrial receptacle such as a dumpster at places of high population density such as apartments, condominiums, office buildings, malls, etc. Individuals typically place trash into the receptacle (often referred to as a dumpster or container), where it is picked up by a truck or some other vehicle that hauls the trash to a recycling center, landfill or to an incinerator. The receptacle is of a fixed volume and limited in the amount of trash it can hold. Similarly, the truck is of a fixed volume and its capacity limited accordingly. To expand this capacity, it has become commonplace to equip the truck, the receptacle or both, with a compactor that reduces the volume of trash. The compactor crushes the trash into a smaller volume by increasing the density of trash particles.

Use of large industrial trash compactors is well known. Moreover, it is common to provide a compactor in conjunction with a receptacle so that the two units cooperate to maximize the capacity of the receptacle. Nevertheless, once the receptacle is full, it must still be emptied. Because the receptacle is substantial in size, it must be emptied by a truck that is specially equipped to manipulate the receptacle. The operation and maintenance of such trucks is expensive. Furthermore, the truck operator, referred to as a hauler, is typically paid a certain rate to empty the receptacle based on the number of trips necessary over a period of time. Thus, the more trips made by the hauler, the more expense is incurred by the receptacle user (or owner). To insure that the receptacle does not overflow with trash, many users of these large receptacles require the hauler to empty the receptacles a certain number of days during the week. Consequently, the hauler is paid by the user to empty the receptacle even if it is not full. This accepted method of waste disposal is not cost effective because the hauler is emptying trash receptacles that have unused capacity.

Several prior art methods are known to address the problem of emptying a less-than-full trash receptacle.

One such prior art method is to secure a photoelectric cell within the interior of the receptacle. This photoelectric cell senses when the receptacle is full of compacted trash and therefore in need of emptying. This particular method is described in U.S. Pat. No. 3,765,147 to Ippolito.

Use of a photoelectric cell can be inaccurate, however, because it can yield a premature indication that a receptacle is full. For example, if a large volume of highly compactable material such as foam rubber is placed in the receptacle and compacted, the photoelectric cell will nonetheless indicate that the receptacle is full and a hauler would be dispatched to empty the receptacle. However in this instance, more trash could be deposited in the receptacle because the foam gives a false reading having obtained maximum capacity. A similar problem with a photoelectric cell is encountered if a particular trash particle should happen to trigger the cell's sensing mechanism. As a further example, should a long board or the like cover the cell (or a plurality of cells), the photoelectric device will register a full receptacle despite the fact that the board may be the only piece of trash in the receptacle. Of course, it is the nature of trash that it is neither uniform nor predictable in its composition. Thus, the potential for a false reading limits the effectiveness of the photoelectric cell as a measuring or monitoring device.

U.S. Pat. No. 4,773,027 to Neuman teaches another prior art method providing an automated trash management system that monitors the fullness of various receptacles within the system. A plurality of remote status units are set up in operative association with a plurality of containers. The remote status units electronically communicate with a central unit that monitors the fullness of each remote trash receptacle. When the central unit learns that a particular remote compacting unit is full as sensed by the remote status unit, a hauler is notified and dispatched to empty that remote compacting unit. The remote status unit of the Neuman patent employs a sensing device that continuously monitors the maximum pressure of the hydraulic system of the compactor. In other words, rather than utilizing a fixed position sensor as taught by Ippolito, Neuman teaches sensing the maximum amount of pressure for a hydraulic piston used to effect the compacting function in order to determine whether the receptacle is full. In theory, if the receptacle is not full, something less than a predetermined maximum amount of pressure will be detected in the hydraulic system.

However, this prior art method of monitoring the fullness of a receptacle is also limited. First, such a method depends entirely upon pressure within the hydraulic system to determine when the trash receptacle is full. If something other than an hydraulic compaction system is employed, the monitoring function is lost. Of course, should the hydraulic system fail, the monitoring function is likewise lost. Should the system develop a small leak or otherwise be operated inefficiently, the monitoring system may inadvertently give false readings. Further, such an apparatus as taught by Neuman is not tolerant of severe weather conditions experienced in various locations where trash compactors are placed. For example, when the weather is extremely cold, the hydraulic fluid surrounding the piston will become less viscous. The Neuman apparatus may mistake the increase in viscosity of the hydraulic fluid as an increase in the volume of trash compacted within the receptacle provided with the trash compactor, and will consequently wrongly determine that the receptacle is full. Financial resources are wasted in this situation because a hauler will be dispatched to empty a less-than-full container.

Accordingly, there is a need in the art for a cost-effective waste disposal system that monitors the fullness of individual trash receptacles and only dispatches a hauler to empty only a full container. The prior art further needs a waste disposal system that is not limited by mechanical operation of the compactor, but rather enhances such operation as the trash is compacted. As a result, the prior art further lacks a monitoring device what accurately measures the fullness of individual trash receptacles in all types of weather conditions and environments.

SUMMARY OF THE INVENTION

The present invention fulfills the needs of the prior art by providing a waste management system that accurately monitors and enhances the compacting action. The present invention further provides a cost-effective waste disposal system that is not limited by the hydraulic systems that may be employed to effect trash compaction, and minimizes false readings.

Generally described, the present invention comprises a waste management system including a plurality of trash receptacles equipped with compactors. Each compactor structure is fitted with a weigh bar that facilitates the compacting action. Each weight bar is in turn provided with at least one strain gauge that monitors the force exerted against the bar as a result of the compacting action. The strain gauges are electrically connected to a remote monitoring and display unit that is, in turn, in communication with the central processing unit.

Described more particularly, the present invention comprises a plurality of trash collection units, each trash collection unit includes a trash receptacle and a compaction assembly. The compaction assembly includes a compactor ram, a slide, a piston, and a hydraulic cylinder that work in combination to effect the trash compacting action. The cylinder is fitted with a pair of yoke brackets that extend outwardly therefrom. The yoke brackets define two openings along an axis therethrough. A fixed weight bar or pin extends through the openings in the yoke brackets to anchor the cylinder. Thus, it is to be understood that the cylinder acts against the pin to effect the trash compacting action. The weigh bar is fitted with at least one strain gauge that senses the amount of strain endured by the weigh bar as a result of the compacting action. This strain reading is electronically transmitted to the remote monitoring and display unit provided with that particular trash collection unit. The strain reading is transmitted to a central processing unit where such strain reading is compared to a predetermined maximum strain reading indicative of a full trash receptacle. If the strain reading equals or exceeds the predetermined maximum strain reading for a sufficient time interval, a hauler is notified and dispatched to empty the receptacle.

Thus, it is to be understood that the amount of force exerted on the weigh bar of the compacting assembly is utilized to measure the fullness of the receptacle because said force is a function of the degree of fullness of the receptacle. More particularly, the amount of strain endured by the weigh bar is a function of the force being exerted by the compacting assembly. If the receptacle is relatively free of trash, the strain (and the corresponding force exerted by the compacting assembly) is minimal. However, if the receptacle is relatively full of trash, the strain is significantly greater because the compacting assembly encounters increased resistance in effecting the compacting action, requiring the exertion of greater force to effect the compacting action.

After the trash has been compacted, the strain measurement is returned in the remote monitoring and display unit until which time it is contact by the central processing unit that compares the strain measurements to a predetermined fullness indicia, an operator stationed at the central processing unit monitors the fullness of each trash collection unit and dispatches a hauler to empty only full trash compactors.

The preferred embodiment of the present invention may further include a display device on the exterior of the collection unit to display one or more strain readings. The display permits the hauler or some other individual to make a remote check of the reading to insure against any communication problems with the central processing unit.

The preferred embodiment of the present invention may further provide for the central processing unit to initialize each strain measurement after taking a reading upon the completion of a compacting cycle. On the basis of such initialization, the central processing unit would redefine the maximum strain reading by recalibrating a "full" indicator given the most recent amount of strain endured by the weight bar.

The preferred embodiment of the present invention may further include cellular telephone units whereby trash collection units not accessible to telephone lines may communicate with the central processing unit.

Thus, it is an object of the present invention to provide an improved waste disposal system.

It is a further object of the present invention to provide an improved waste disposal system including trash compacting system that accurately measures the fullness of a receptacle.

It is a further object of the present invention to provide an improved trash compacting system that insures the effective disposal of trash in terms of both economics and space utilization.

It is a further object of the present invention to provide an improved trash compacting system which can accurately monitor the fullness of a plurality of trash receptacles.

It is a further object of the present invention to provide an improved trash compacting system that avoids the problems associated with monitoring the fullness of a receptacle by sensing the pressure of an hydraulic system utilized to effect the compaction of trash.

It is a further object of the present invention to provide an improved trash compacting system that eliminates false readings due to increased or decreased viscosity in an hydraulic system resulting from changes in environmental conditions.

It is a further object of the present invention to provide an improved trash compacting system that determines fullness of a receptacle as a function of the strain exerted on the structure of the unit by the compacting assembly.

It is a further object of the present invention to provide an improved trash compacting system that utilizes strain gauge technology within the external structure of the device to sense the internal fullness of a trash receptacle.

It is a further object of the present invention to provide an improved trash compacting system that includes cellular telephone technology to permit remote status monitoring even where conventional telephone lines are unavailable.

It is a further object of the present invention to provide an improved trash compacting system that is not limited by the workings of the compacting assembly, but rather enhances that assembly by facilitating the compacting action by use of a minimal number of component parts.

It is a yet further object of the present invention to provide an improved trash compacting system that displays pertinent information on the remote site so as to insure proper working of the system components.

These and other features of the present invention will become readily apparent from a reading of the following detailed description taken in conjunction with the accompanying drawings.

DETAILED DESCRIPTION OF THE INVENTION

Figure 1:
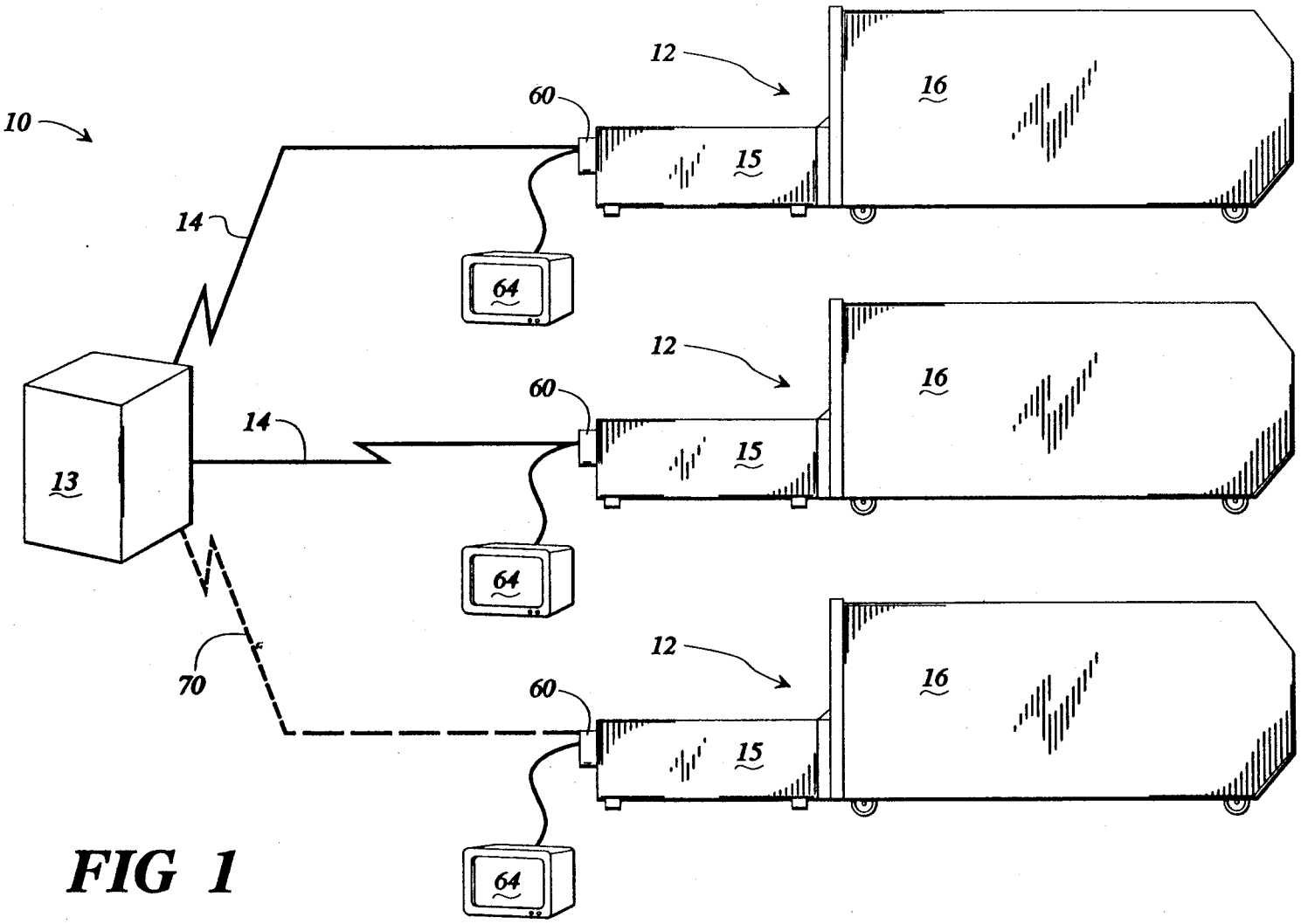
FIG. 1 is a diagrammatic, schematic illustration of an improved trash compacting system according to the present invention.

Referring now in more detail to the drawing figures, in which like numerals represent like parts throughout the several views, FIG. 1 shows a waste disposal system 10 according to the present invention. The waste disposal system 10 includes a plurality of trash collection units 12, each of which includes a compaction assembly 15 and a trash receptacle 16. The trash collection units 12 communicate with a central processing unit 13 by way of conventional telephone lines 14 or cellular telephone technology, indicated by the dashed line 70. It is to be understood that when the trash is being compacted, a force is exerted by the compaction assembly 15 onto the trash in the receptacle 16. Because the compaction assembly 15 is both anchored to the ground and secured to the receptacle 16, this force exerts a strain on the structural components of the compaction assembly 15, particularly—a weigh bar 20 that, as described in greater detail below, anchors the compacting assembly components. The strain endured by the weigh bar 20 is measured. This measurement is transmitted to the central processing unit 13 via the telephone lines 14 or cellular telephone technology 70, where it is continuously monitored by an operator or an electronic compactor means. FIG. 1 further shows a remote status monitoring device 60 that, as also described in greater detail hereinbelow, provides a display 64 whereby an operator can monitor the strain measurements at the location of the trash collection unit 12.

At the outset, it will be appreciated that the present invention is not limited by the telecommunication devices employed to effect the link between the trash collection units 12 and the central processing unit 13. For example, those of ordinary skill in the art will recognize that a modem or some like signal modulating and demodulating device may be employed conventionally to convert the digital signal input from the status monitoring device 60 into analog signals suitable for transmission across the telephone network and back into digital signals for receipt by the central processing unit 13. As a further example, the present invention includes the use of cellular telephone technology that permits the transfer of information from any particular trash collection unit 12 to the central processing unit 13, no matter where the collection unit may be located. This technology permits remote monitoring of trash collection units 12 that are not located in an area accessible to conventional hardwire telephone lines. Such cellular telephone technology is well known and need not be further disclosed herein.

Figure 1A:
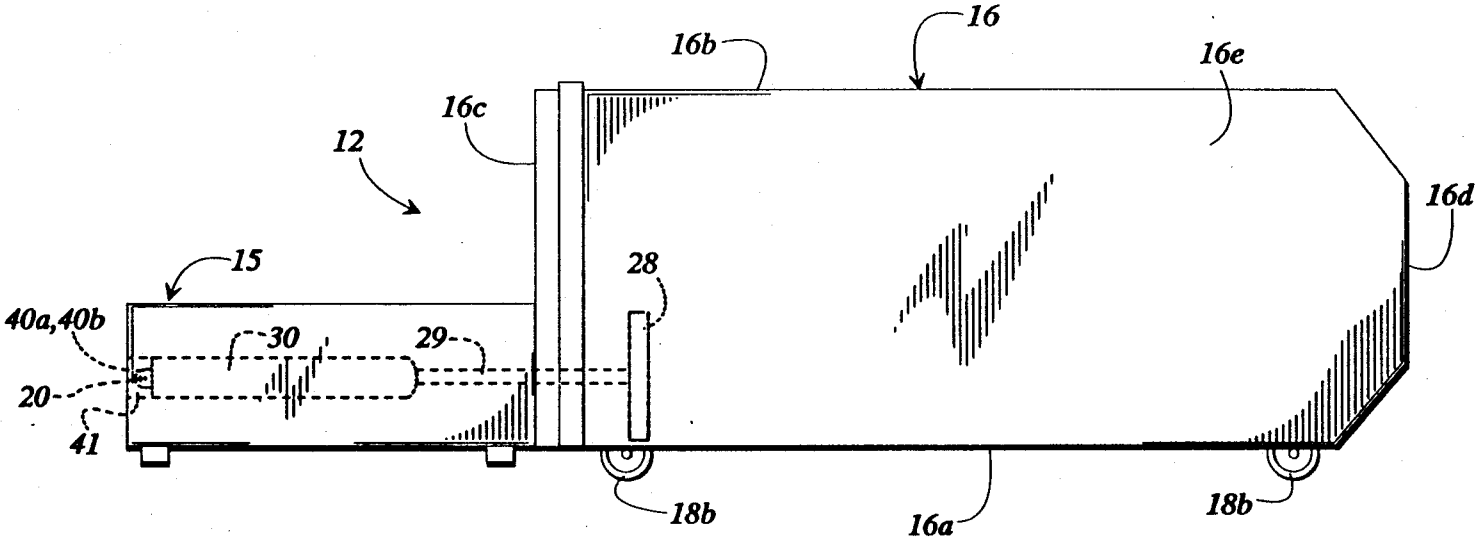
FIG. 1A is a side elevation view of an individual trash collection unit as shown in FIG. 1.
Figure 2A:
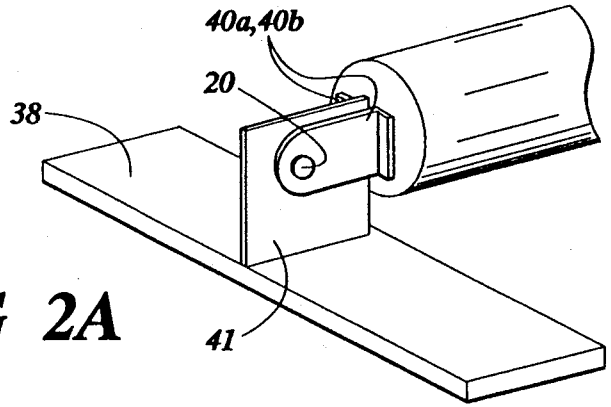
FIG. 2A is an isolated view of the compacting assembly components shown in FIG. 2.
Figure 2:
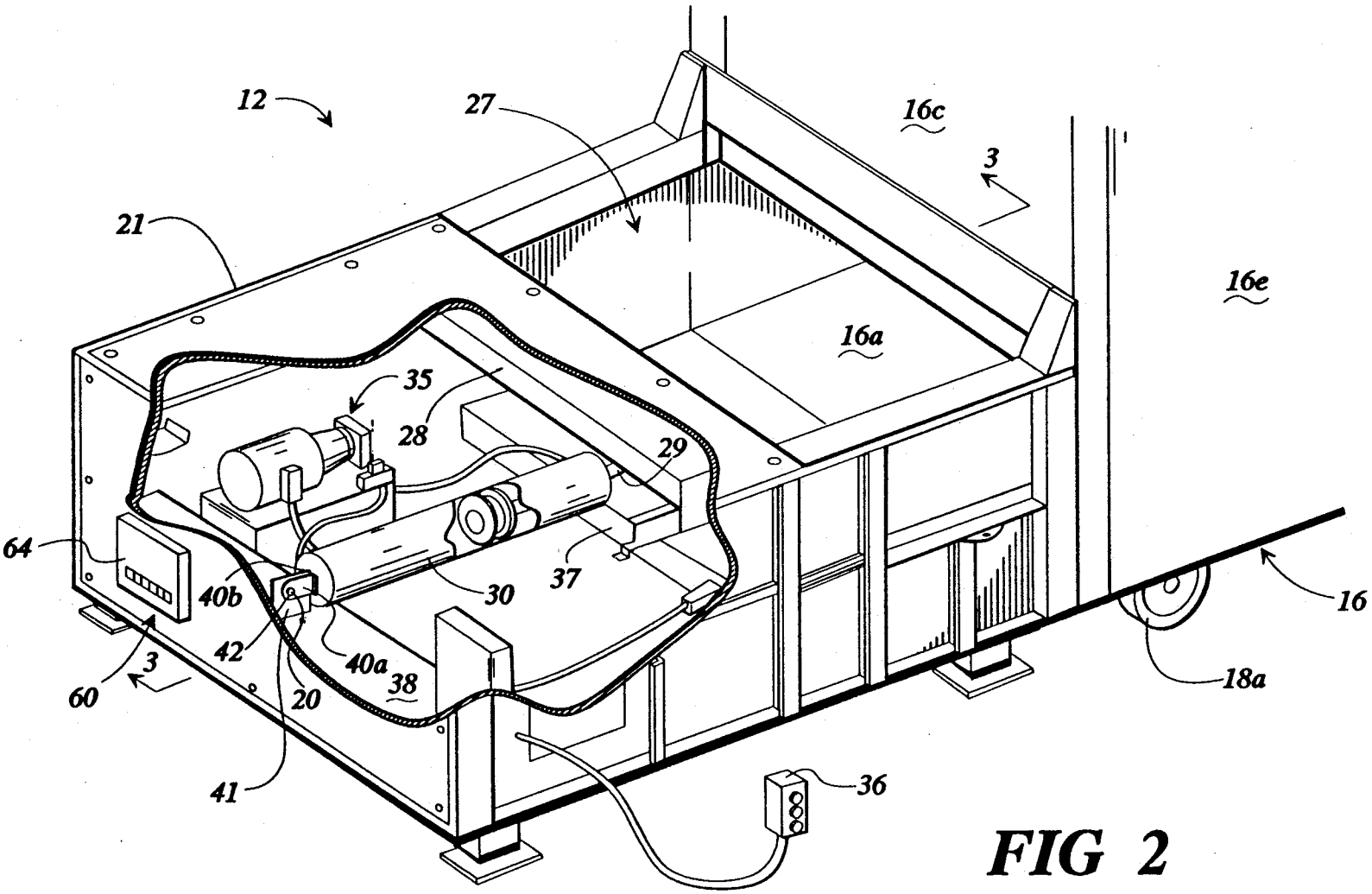
FIG. 2 is a perspective, cut-away view of a trash compactor unit of the embodiment shown in FIG. 1.

Referring now in more detail to FIG. 2 wherein a particular trash collection unit 12 is illustrated, it is to be understood that each trash collection unit 12 is substantially identical in construction. Accordingly, only one of the trash collection units 12 is disclosed. The trash collection unit 12 is, generally speaking, comprised of the compaction assembly 15 and the receptacle 16. The receptacle 16 is an elongate member comprised of a floor **16*a*, a ceiling 16*b*, a left side wall 16*c* that faces the compaction assembly 15, a right side wall 16*d*, a front wall 16*e* and a back wall (not shown). It is to be understood that the left wall 16*c* is only a partial wall in that the left bottom side of the receptacle 16 is an opening that facilitates the compacting action as described below. The compaction assembly 15 and receptacle 16, when positioned as shown in FIG. 1A, are locked together to insure cooperation therebetween. The details of such a locking arrangement are well known and conventional. The receptacle 16 further includes four wheels, only two of which are shown at 18*a* and 18*b*. Those skilled in the art will appreciate that the wheels permit the receptacle 16 to be disengaged from the compaction assembly for removal of the compacted trash and for transport to another compaction assembly 15**, if necessary.

The compacting assembly 15, as shown in the drawing figures, is positioned to the left of the receptacle 16 and cooperates therewith to compact the trash. The compacting assembly 15 provides a housing 21, the top surface of which defines an opening or chute 27 through which trash is introduced into the collection unit 12. The trash falls to the floor of the housing 21 and of the receptacle 16. The compacting assembly 15 further consists of a ram having a face 28 connected to one end of a rod 29. The rod 29 is connected at its other end to a hydraulic cylinder 30. The ram face 28 and the rod 29 can be formed of any suitable material for repeated engagement with the trash whereby the compacting action is effected. The cylinder 30 is conventional in that it is powered by a hydraulic system that is well known in the art, indicated generally at 35. Those of ordinary skill in this art will further recognize that the cylinder 30 may also be powered by a pneumatic system or even some mechanical linkage. It is to be understood that each such powering system is contemplated to be within the scope of the present invention since the system will, regardless of the particular powering mechanism, cause the ram face 28 to engage the trash deposited into the receptacle 16. This will result in a strain on the compacting assembly components.

It is to be understood that the compacting assembly 15 is electrically-powered in that the hydraulic system described above is responsive to an electrical stimulus. Thus, upon receipt of such an electrical stimulus, a generator powers the cylinder 30 such that the rod 29 and the ram face 28 are hydraulically pushed forward toward the trash receptacle 16. As a result, the forward portion of the ram face 28 engages the trash in the receptacle 16 and moves the trash in a forward direction until it is compacted against the far end of the trash receptacle 16. Once the rod 29 and the ram face 28 have travelled a full, predetermined length, the generator reverses the hydraulic operation to withdraw the rod 29 and the ram face 28 from the receptacle 16. The compaction cycle is completed once the rod 29 and the ram face 28 are in their initial start position. Such operation of a hydraulic cylinder is known in the art. A remote start and stop switch 36 is shown on the exterior of the housing 21.

Figure 4:
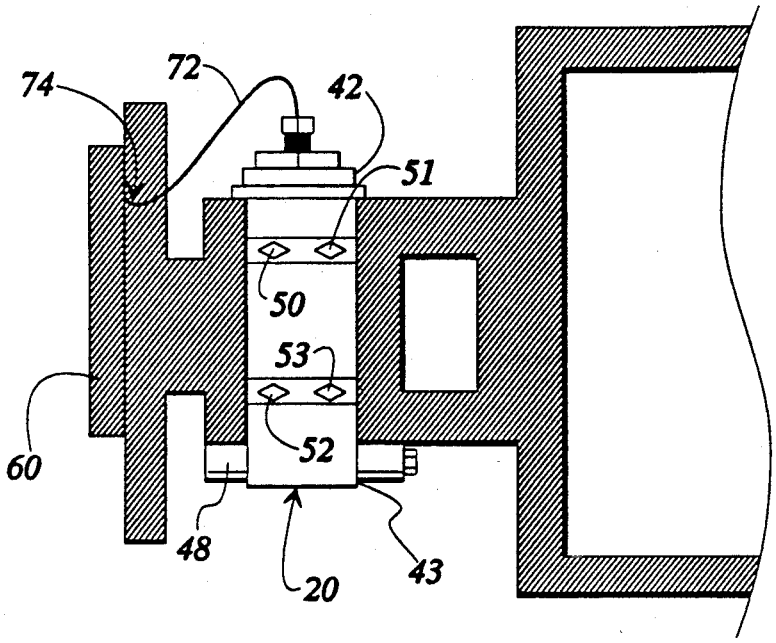
FIG. 4 is a section view taken along line 4—4 in FIG. 3.

Referring further to FIGS. 2, 2A and 4, it is seen that the hydraulic cylinder 30 is fixedly secured at its end to a pair of yoke brackets 40*a*, 40*b*. A vertical plate 41 is fixedly secured to the rear wall of the compacting assembly housing and a shelf 38. The brackets 40*a*, 40*b* project outwardly rearwardly of the cylinder 30 and define a pair of openings 42 and 43 along an axis perpendicular to the cylinder 30. The brackets 40*a*, 40*b* may be secured to the cylinder by welding or fasteners or by any other suitable means. The vertical plate 41 defines an opening parallel to the yoke bracket openings 42 and 43 through which the weigh bar 20 projects to further secure the weigh bar. The vertical plate 41 is fixedly secured to the shelf 38 and butts against the rear wall of the housing 21. The weigh bar 20 is secured within the openings 42 and 43. The weigh bar 20 is secured in this position by an anti-rotation member 48 that prevents the weigh bar 20 from rotating within the openings 42 and 43 of the yoke bracket 40*a* and 40*b*, respectively. The weigh bar 20 may be secured in such position by any appropriate means, including by an enlargement of the end portions thereof. Once secured, it will be appreciated that the cylinder 30, when activated to effect the compacting action, acts against the weigh bar 20. Thus, the weigh bar 20 facilitates the compacting action of the assembly 15.

Figure 3:
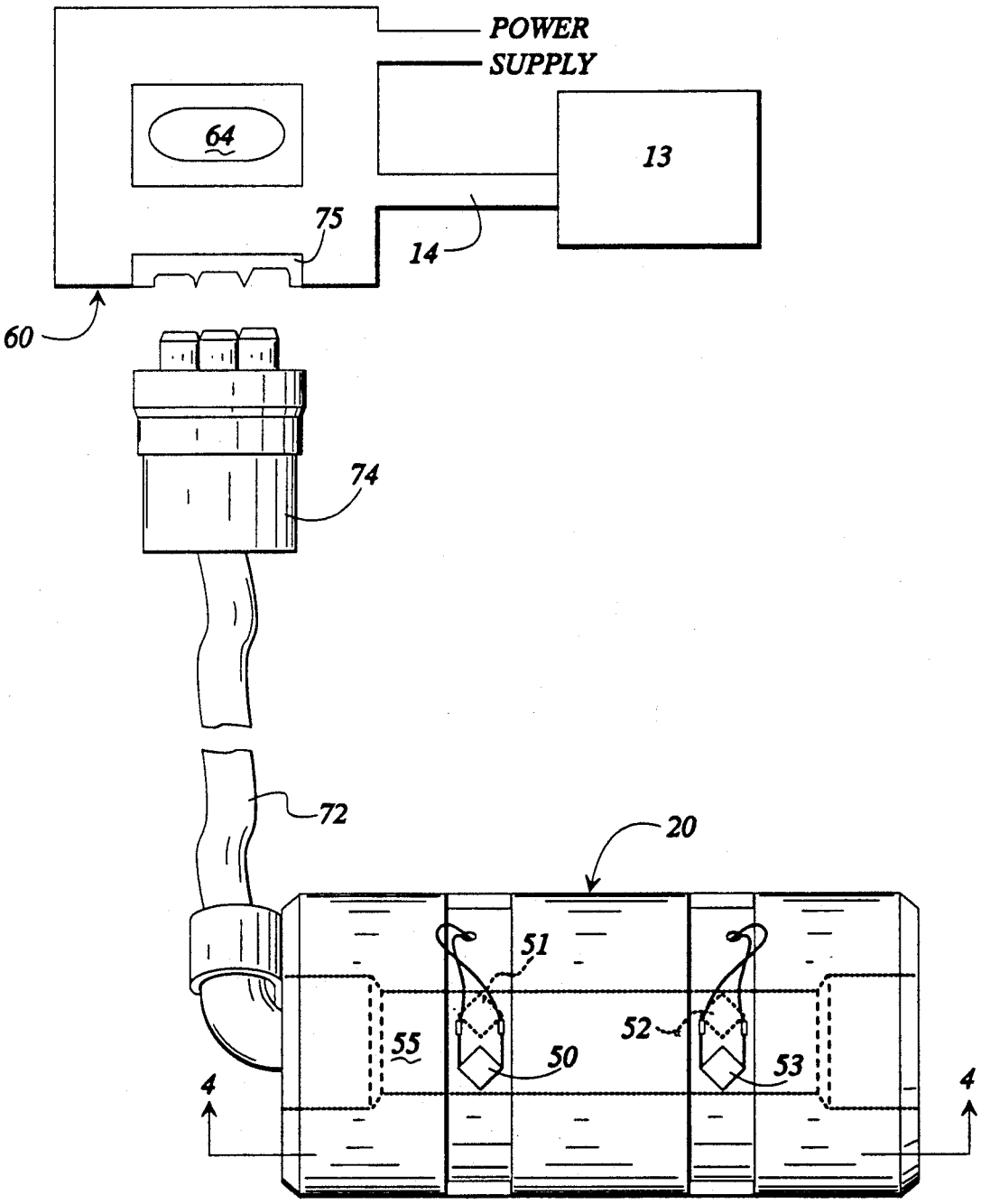
FIG. 3 is a section view taken along line 3—3 in FIG. 2.

FIG. 3 illustrates the weigh bar 20 in isolation. As shown, the weigh bar 20 includes four (4) strain gauges 50, 51, 52 and 53. These gauges 50–53 are embedded within the interior of the weigh bar 20, which is filled with an epoxy resin to provide a solid, unitary pin 55. The strain gauges 50–53 are electrically powered to monitor the strain exerted by the cylinder 30 against the weigh bar 20. The bar 20 is prevented from rotating by the anti-rotation member 48. Thus, the weigh bar 20 provides the base to which the cylinder 30 is attached.

During each above described compacting cycle, a stress is exerted on the weigh bar 20 and detected by the four internally mounted strain gauges 50, 51, 52, and 53. This stress measurement is then sent to a status monitoring device 60. The status monitoring device 60 includes a light-emitting diode (LED) device 64 mounted on the exterior of the compactor assembly 15. It will be appreciated that the remote status monitoring device 60 may in certain cases be mounted on the interior of a unit to insure against tampering, vandalism or the like. Also, in environments of extreme weather conditions, it may once again be desirable to mount the remote status monitoring device on the interior of the unit. The remote status monitoring device 60 is preferably connected by a modem and conventional telephone wire 14 (or cellular telephone technology) to the central processing unit 13. Further to FIG. 3, the weigh bar 20 is connected to the remote status monitoring device by a cable 72 attached to a plug 74. The plug 74 is configured for receipt by a plug 75 provided on (or within) the remote status monitoring device 60. The remote status monitoring device 60 includes electronic circuitry that captures the force reading obtained by the strain gauges 50–53 and displays such information at the LED device 64. Such electronic circuitry is well known and need not be disclosed further herein. An operator is thus able to monitor an individual trash collection unit 12 on site. An operator stationed at the central processing unit 13 is thus also able to monitor individual trash collection units 12 and review the stress measurements from multiple compactor assemblies 15. It is to be understood that as more trash is being compacted in the receptacle 16, a greater strain is endured by the weigh bar 20. Once the weigh bar 20 is subjected to an equal or greater level of stress than a predetermined amount, such level of stress is indicative of a full receptacle 16 because the force exerted against the ram face 28 is correlative to the amount of trash in the receptacle.

It can be appreciated that the increase in strain exerted against the weigh bar 20 of the compactor assembly 15 and read by the strain gauges 50–53 is directly proportional to the fullness of each trash compactor 12. In theory, the stress gauges should read an increased level as more trash is deposited into the trash receptacle 16. A normal increase in strain measurements after each compaction cycle can also be calculated. A normal input of trash per a given time period can be likewise empirically determined. Thus, the operator at the central processing unit 13 can monitor the incremental increase in strain measurements taken from individual trash collection units 12. The operator is apprised as to what the normal increase in load measurements should be and at what particular stress measurement a trash compactor 12 is sufficiently full.

When a trash compactor 12 reaches this predetermined load measurement, the operator at the central processing unit 13 will do one of two things: he will either call a hauler to empty that particular full trash compactor or will notify the customer that his trash compactor is full and needs to be emptied. By utilizing this type of accurate waste monitoring system, the customer saves money because he only pays a hauler to empty his trash compactor when it is full.

The operator will also know the normal increase in load detected during each successive compaction cycle. Therefore, if there is an unusually large increase in the strain reading after a single compaction cycle, the operator will not dispatch a hauler because the compactor probably is not full. The operator will usually watch the strain measurements for a few compaction cycles to see if the large increase in the strain measurements reflects an accurate determination that the trash compactor is full and ready for emptying.

Figure 5:
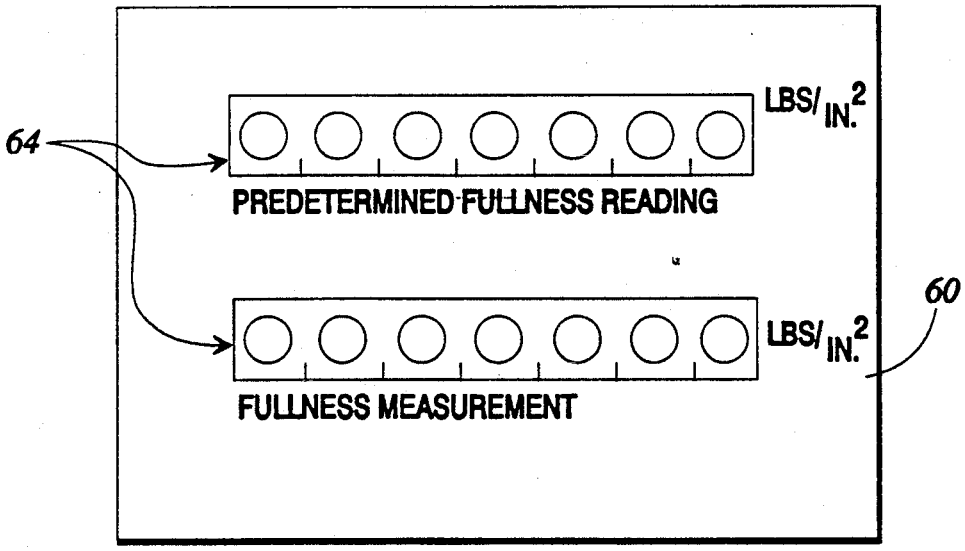
FIG. 5 is a plan view of a display monitor in accordance with the present invention.

FIG. 5 illustrates a perspective view of the status monitoring device 60 equipped with an LED device 64. A status monitoring device 60 is mounted on the exterior of the back wall 22 of the trash compactor 12. The status monitoring device 64 is electronically connected to the strain gauges 50–53 for transmission of the stress measurements. The status monitoring device 60 with the LED device 64 is preferably equipped with a microprocessor so as to store pertinent data and information as required by the user in sight and to be retrievable by the trash manager at the remote location. For example, the microprocessor may store the predetermined fullness reading, determined empiracally, whereby the actual fullness reading may be compared thereto to determine whether the receptacle 16 is full. It will be appreciated that the strain measurements may be given in pounds per square inch or any other appropriate measurement. Those skilled in the art will appreciate that the microprocessor provided with the remote status monitoring device 60 may effect the comparator function also provided by the central processing unit. At either location, software may be employed to permit constant monitoring of actual fullness levels as indicated by the strain gauges 50–53 and constant comparing of said actual fullness levels to predetermined fullness readings to permit efficient utilization of haulers and associated equipment to effect removal of the compacted trash from the receptacles 16.

Moreover, many trash compactors and collection units 12 may not placed in areas accessible to telephone lines, making it difficult to transmit the data from the trash compactor to the central processing unit. To solve the problem, each trash collection unit 12 may be outfitted with a cellular receiver 70, thereby enabling the transmission of load data from the compactor to the central processing unit without the use of telephone lines.

In view of the foregoing, it will be appreciated that the present invention accomplishes the objects set forth above and overcomes the previously described drawbacks of the prior art. It will be appreciated that many alternative embodiments of the present invention can be created and therefore the scope of the present invention is to be limited only by the claims below.

Other objects, features, and advantages of the present invention will become apparent upon reading the following detailed description in conjunction with the drawings and appended claims.

What is claimed is:

1. An apparatus to monitor the fullness of a trash collection unit, said apparatus comprising:

a trash receptacle;

a compactor assembly to compact trash placed in said trash receptacle, wherein said compactor assembly further comprises a compactor ram face, a rod, means for manipulating said ram face and said rod, and a weigh bar for supporting said compaction assembly; and means mounted internally within said weigh bar for measuring the load stress exerted on said weigh bar of said compactor assembly during operation thereof, said measuring means comprising a strain gauge, whereby said stress measurements are indicative of the amount of trash in said trash receptacle.

2. The apparatus of claim 1 further comprising means for sending said stress measurements to a central processing unit remote of said trash receptacle whereat said stress measurements may be compared to a predetermined stress measurement indicative of a full receptacle.

3. The apparatus of claim 1 further comprising a display device to display said stress on said compacting assembly during each successive compaction cycle.

4. The apparatus of claim 3 wherein said display device is mounted on the exterior of said compactor assembly.

5. The apparatus of claim 3 wherein said display device is mounted within the housing of said compactor assembly.

6. An apparatus for monitoring the fullness of a trash collection unit comprising:

a trash receptacle;

a chute for receiving trash into said trash receptacle;

a compactor assembly comprising a ram, a slide, a piston, a hydraulic cylinder and weigh bar, said weigh bar supporting said hydraulic cylinder and piston in such a manner that, upon activation of said piston, the ram is cycled into said receptacle to effect compaction of any trash therein; and an electronic sensing device secured within said weigh bar for measuring the stress thereon as a result of said cycling of said ram such that any shear stress experienced by said weigh bar is measured and monitored.

7. The apparatus of claim 6 wherein said electronic device for measured said stress exerted on said compaction assembly comprises a strain gauge.

8. The apparatus of claim 6 further comprising a conventional light-emitting diode display device to display said stress exerted on said compacting assembly during each successive compaction cycle.

9. A waste disposal system comprising:

a plurality of trash collection units, each of said trash collection units further comprising, a trash receptacle, a chute for receiving trash into said receptacle, and a compactor assembly operably connected to said trash receptacle comprising a compactor ram having a ram face for engaging trash within said receptacle, a rod connected at one end to said ram face, a hydraulic cylinder operably connected to said rod to effect manipulation of said ram face, a yoke bracket extending outwardly of said cylinder, a weigh bar fixedly secured within said yolk bracket, and a plurality of strain gauges embedded within said weigh bar for measuring the strain exerted on the weigh bar by the action of said compacting assembly to thereby measure the fullness of each said trash collection unit utilizing the stress exerted on said weigh bar as indicative of the volume of trash contained in each said receptacle;

a central processing unit for monitoring the fullness of each said trash collection unit and comparing said fullness to a predetermined fullness reading; and means for transmitting each said fullness measurement of each said trash collection unit to said central processing unit, whereby upon determining that any one of said plurality of trash collection units have exceeded said predetermined fullness reading, said unit may be emptied for trash.

* * * * *